US009534736B2

(12) United States Patent
Scheuring et al.

(10) Patent No.: US 9,534,736 B2
(45) Date of Patent: Jan. 3, 2017

(54) DEVICE FOR SUPPLYING GAS

(71) Applicants: TGE MARINE GAS ENGINEERING GMBH, Bonn (DE); Rainer Scheuring, Böhl-Iggelheim (DE)

(72) Inventors: Rainer Scheuring, Bohl-Iggelheim (DE); Annette Kalsbach, Lohmar (DE); Thomas Klick, Wesseling (DE); Hans-Christian Haarmann-Kuhn, Bruhl (DE)

(73) Assignees: TGE Marine Gas Engineering GmbH, Bonn (DE); Rainier Scheuring, Bohl-Iggleheim (DE)

( * ) Notice: Subject to any disclaimer, the term of this patent is extended or adjusted under 35 U.S.C. 154(b) by 148 days.

(21) Appl. No.: 14/400,716

(22) PCT Filed: May 16, 2013

(86) PCT No.: PCT/EP2013/001459
§ 371 (c)(1),
(2) Date: Dec. 30, 2014

(87) PCT Pub. No.: WO2013/170964
PCT Pub. Date: Nov. 21, 2013

(65) Prior Publication Data

US 2015/0121903 A1 May 7, 2015

Related U.S. Application Data

(60) Provisional application No. 61/647,556, filed on May 16, 2012.

(51) Int. Cl.
*F17C 7/04* (2006.01)
*F17C 13/04* (2006.01)

(52) U.S. Cl.
CPC ..... *F17C 7/04* (2013.01); *F17C 13/04* (2013.01); *F17C 2205/0338* (2013.01);
(Continued)

(58) Field of Classification Search
CPC ..... F17C 7/04; F17C 227/0135; F17C 2250/0626; F17C 2205/0338; F14C 9/02
See application file for complete search history.

(56) References Cited

U.S. PATENT DOCUMENTS 4,887,857 A * 12/1989 VanOmmeren ..... F17C 5/02 141/1
5,590,535 A * 1/1997 Rhoades ..... F17C 9/02 62/50.2

(Continued)

*Primary Examiner* — Emmanuel Duke
(74) *Attorney, Agent, or Firm* — Thomas & Kareski, P.C.

(57) ABSTRACT

Device for supplying evaporated gas from a storage tank to a consumer at varying pressure and mass flow requirements, having: a high-pressure pump for the liquefied gas, the speed of which determines the mass flow of the pumped liquefied gas; an evaporator for the liquefied gas; a pressure-regulating valve for the evaporated gas, the outlet of which is connected to the consumer; a first regulator, the measured variable of which is the pressure of the evaporated gas and the manipulated variable of which acts on the pressure-regulating valve; a second regulator, the measured variable of which is the pressure of the gas and the manipulated variable of which acts on a rotational speed controller for the high-pressure pump; and means for combining the manipulated variable of the two regulators in such a manner that the manipulated variable of the first regulator additionally acts on the rotational speed controller.

10 Claims, 1 Drawing Sheet

(52) U.S. Cl.
CPC ..... *F17C 2223/0153* (2013.01); *F17C 2227/0135* (2013.01); *F17C 2250/0626* (2013.01)

(56) References Cited

U.S. PATENT DOCUMENTS

| | | | | | |
|---|---|---|---|---|---|
| 5,687,776 | A * | 11/1997 | Forgash | F17C 5/007 | 141/11 |
| 6,474,101 | B1 * | 11/2002 | Quine | F17C 7/04 | 62/50.2 |
| 2006/0222523 | A1 * | 10/2006 | Valentian | F17C 7/04 | 417/313 |
| 2007/0175226 | A1 * | 8/2007 | Karlsson | B63J 99/00 | 62/50.6 |

* cited by examiner

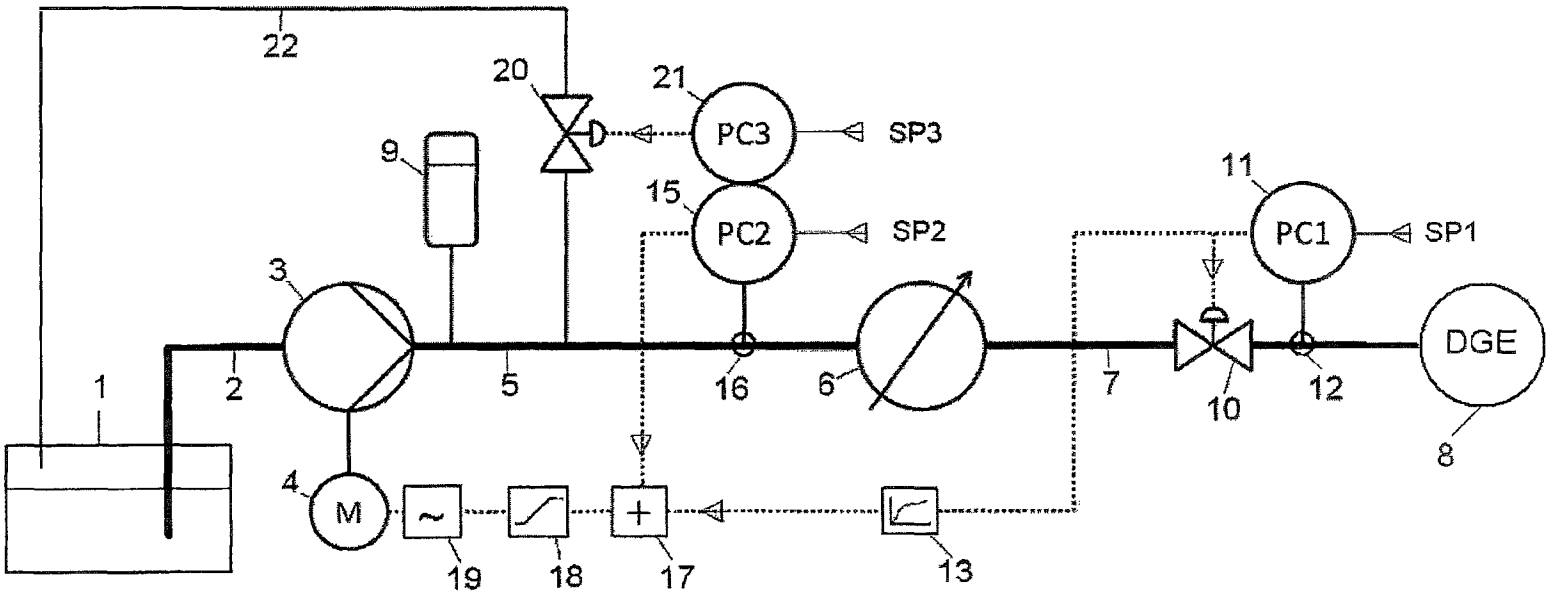
DGE
8
SP1
PC1
11
12
10
7
13
SP3
SP2
6
PC3
PC2
21
15
16
17
20
5
18
9
19
M
3
4
22
2
1

DEVICE FOR SUPPLYING GAS

CROSS-REFERENCE TO RELATED APPLICATIONS

This is a National Stage Entry into the United States Patent and Trademark Office from international PCT Patent Application No. PCT/EP20131001459, having an international filing date of May 16, 2013 and which further claims the benefit of U.S. Provisional Patent Application Ser. No, 61/647,556, filed May 16, 2012, the contents of each of which is incorporated herein by reference.

FIELD OF THE INVENTION

This invention relates to an apparatus for supplying a consumer with gas from a store of cryogenic liquefied gas, in particular liquefied natural gas (LNG). Primarily, these are consumers which use fuel gas, e.g. engines. Other consumers, however, also are to be considered, e.g. those which require purge gas. In any case, the consumers expect that the gas is supplied to them with a pressure specified by the consumer and to be maintained exactly, which temporally varies in dependence on the working state of the consumer and also can experience sudden changes. The temporal quantity of the gas requested, i.e. the mass flow of the gas, normally is not constant either, but depends on the load of the consumer.

BACKGROUND

Typical consumers for which the invention is relevant include diesel engines for marine propulsion systems or smaller, electricity-producing power plants which selectively are operated with gas, namely such that with every working cycle a certain amount of gas under high pressure is introduced into the cylinder in addition to the diesel oil, the so-called pilot oil. The gas demand of these engines possibly changes quickly. The requested pressure is dependent on the respective power of the engine and for LNG typically lies between 150 and 300 bar. The changes in terms of pressure and mass flow are particularly pronounced and abrupt when in a group of consumers, e.g. in a power plant group, one consumer or engine suddenly fails completely, e.g. due to an emergency shut-off. The apparatus which supplies such consumers with gas must be able to comply with such changes.

An approach for the solution of this problem consists in that a large amount of evaporated, i.e. gaseous gas under high pressure oriented towards the maximum pressure of the consumer constantly is provided, in order to be able to compensate the fluctuations in consumption.

However, this procedure is very expensive in terms of safety, because a larger amount of gas which is under high pressure is dangerous on principle.

Another approach consists in that the gas is pressurized by means of a pump when it still is in the liquid state, an excess thereof, based on the actually required mass flow, is withdrawn from the storage tank, and the partial quantity not required again is recirculated into the storage tank. Since the liquid gas also heats up due to the increase in pressure, heat constantly is introduced into the store of cryogenic liquefied gas with the consequence that the undesired formation of boil-off gas in the storage tank is increased. Due to the related increase in pressure in the storage tank, which is not designed for high pressure, this represents a problematic source of danger in particular on board a ship.

If one renounces the provision of buffer quantities of gas, which is under pressure, and attempts to satisfy the requirements of the consumer in terms of pressure and mass flow of the supplied gas alone with the usual means of control, one quickly is faced with limits. The control either is too slow to be able to reproduce a short-term pressure increase or pressure drop taking place within few seconds, or it tends to uncontrolled feedback oscillations of the gas pressure.

SUMMARY

The apparatus according to the invention, which is defined in claim 1, helps to exactly maintain the pressure of the gas delivered to the consumer corresponding to the requirement profile of the consumer, also in the case of difficult consumers, e.g. diesel-gas engines, with very high requirements concerning the static and dynamic accuracy of the gas pressure.

In the apparatus according to the invention, the still liquid gas initially is brought to a high pressure in a manner known per se and then, in the state of high pressure, evaporated e.g. by supplying heat via a heat exchanger, i.e. is transferred into the gaseous state. Two controllers are present, of which a first controller controls the pressure of the gas delivered to the consumer via a pressure control valve located behind the evaporator in flow direction, while a second controller controls the pressure of the gas before the pressure control valve and behind the high-pressure pump utilized for pressure increase by adjusting the mass flow of the gas delivered by the high-pressure pump. In the apparatus according to the invention this mass flow now is influenced not only by the correcting variable of the second controller, but in addition also by the correcting variable of the first controller acting on the pressure control valve behind the evaporator.

What is equivalent to the adjustment of the mass flow of the gas is an adjustment of the volume flow of the gas, because both variables are proportional to each other with the density, more exactly the volumetric density of the mass of the gas, at the place of adjustment as proportionality factor.

Preferred means for combining the correcting variables of the two controllers are characterized in claims 2, 3 and 4. Thus, the mass flow preferably depends on a sum of the two correcting variables, possibly with a limitation of the sum corresponding to the admissible signal range of the adjusting device for the mass flow, and possibly furthermore with an individual influence of the correcting variable of the first controller according to a particular, preferably dynamic transfer function, as far as the correcting variable also is utilized for adjusting the mass flow.

According to claim 6, the mass flow adjustment preferably is realized via the speed of the high-pressure pump determining the mass flow, by providing an electric motor together with an associated, commercially available speed controller for driving the high-pressure pump, which uses the combination of the two correcting variables for speed adjustment.

The broadening of the apparatus according to the invention as claimed in claim 7 is not intended to provide for a permanent "excess" operation of the apparatus. Rather, this development takes account of the fact that usual high-pressure pumps have a lower mass flow limit, below which they no longer operate satisfactorily. Thus, there is a smallest mass flow of the gas, below which the pump cannot go. Normally, the third controller only takes action, by starting to open the associated second pressure control valve and hence providing for a recirculation of liquid gas into the storage tank, when the consumer asks for a mass flow which is so small that it lies below the minimum value of the high pressure pump.

The second and the third controller each can have their own pressure sensor, but preferably are connected to a common pressure sensor. In principle, it is not decisive whether the same is arranged before or behind the evaporator in flow direction. In the preferred exemplary embodiment, the pressure sensor detects the pressure of the liquid gas before the evaporator.

The setpoints characterized in claims 6 and 8 are applicable for the regular operation of the apparatus according to the invention. However, other designs also are possible, either permanently or for certain exceptional cases, e.g. in the case of an emergency shut-off of a consumer, a fast gas shut-off or a very fast change of the gas pressure at the output of the apparatus.

The apparatus according to the invention preferably is used on board ships for supplying the marine propulsion system with natural gas (LNG), in particular when the marine propulsion system comprises so-called MEGI engines which are operated with diesel oil and gas, as described above. These engines request that the LNG be provided at their input at a specified pressure with high accuracy. The pressure values can vary strongly within a wide pressure range; typical values are 150 to 300 bar. The apparatus according to the invention also is capable of exactly following fast pressure ramp courses. This can be realized in the apparatus
according to the invention, although the mass flows requested by the marine engine can be completely different independent of the pressure requirement.

More recently, there are also discussed marine propulsion systems with engines which burn LPG (classical liquefied gas with the main constituents propane, propene, butane, butene, isobutane and/or isobutene). With this medium, the required pressure level even is considerably higher than with LPG; it goes up to 600 bar. On the other hand, the lowest temperatures are not as low as with LNG, so that the problems of the boil-off gas are less pronounced. Nevertheless, the apparatus according to the invention for supplying the corresponding marine engine with gas also is to be preferred to the known apparatuses.

BRIEF DESCRIPTION OF THE DRAWING

The invention will subsequently be explained in detail with reference to a preferred exemplary embodiment. The only FIGURE shows a process flow diagram of an apparatus according to the invention.

DETAILED DESCRIPTION

A storage tank 1 contains liquefied natural gas (LNG). Via a withdrawal line 2, a high-pressure pump 3 which is driven by an electric motor 4 is connected to the storage tank 1. A connecting line 5 leads from the output of the high-pressure pump to an evaporator 6. From the evaporator 6 an output line 7 leads to a consumer 8, here in the form of a diesel engine, which in addition is operable with high-pressure gas. To the output of the high-pressure pump a damper 9 also is connected.

The high-pressure pump 3 driven by the electric motor 4 takes cryogenic liquefied gas from the storage tank 1 and puts it under high pressure. The damper 9, a container filled partly with liquid gas and partly with self-evaporated gas, damps the resulting pressure oscillations in the liquefied gas. From the high-pressure pump 3, the liquefied gas flows to the evaporator 6 via line 5. In a manner not illustrated in detail, said evaporator comprises a heat exchanger by means of which the liquefied gas is heated and thereby evaporated. The evaporated gas, which hence is gaseous and has the high pressure generated by the high-pressure pump 3, flows to the diesel-gas engine 8 via the output line 7.

In the output line 7 a pressure control valve 10 is inserted, which is adjusted by a first controller 11. The controller 11 detects the pressure of the gas in flow direction behind the pressure control valve 10 as control variable by means of a pressure sensor 12 and from said control variable as well as from an externally specified setpoint SP1 forms the correcting variable for the pressure control valve 10.

Via a pressure sensor 16, a second controller 15 detects the pressure of the liquid gas in the connecting line 5 as control variable and from said control variable as well as from an externally specified setpoint SP2 forms a correcting variable which is delivered to an input of an adder 17. To the other input of the adder 17 the correcting variable of the first controller 11 is delivered via a transfer element 13. The transfer element 13 modifies this correcting variable, as far as it is supplied to the adder 17, pursuant to a dynamic transfer function realized in the transfer element, which can be adapted to the individual conditions of the apparatus.

To the output of the adder 17 a speed controller 19 for the electric motor 4 is connected via a limiter 18. The limiter 18 limits the sum of the two correcting variables formed in the adder 17 to the admissible signal range of the speed controller 19. The speed controller 19 for example is formed as frequency converter, which via the frequency of the feed current supplied to the electric motor 4 adjusts the speed of the electric motor pursuant to the limited sum of the two correcting variables from the controllers 11 and 15 and hence also the mass flow of the liquefied gas delivered by the high-pressure pump 3.

To the connecting line 5 a second pressure control valve 20 finally is connected, whose output is connected with the storage tank 1 via a return line 22. When the pressure control valve 20 opens, liquefied gas can flow back to the storage tank 1 via the return line 22. The pressure control valve 20 is actuated by the correcting variable of a third controller 21, which as control variable receives the pressure of the liquefied gas behind the high-pressure pump 3 via the pressure sensor 16 like the controller 15, and from said control variable as well as from an externally specified setpoint SP3 forms the correcting variable for the pressure control valve 20.

Normally, the setpoint SP2 of the second controller 15 is higher than the setpoint SP1 of the first controller 11, and the setpoint SP3 of the third controller 21 in turn is higher than the setpoint SP2 of the second controller 15.

The controllers 11 and 15 together adjust the pressure of the evaporated gas which flows to the diesel-gas engine 8. The third controller 21 effects a decrease of the gas pressure at the output of the high-pressure pump 3, when the lower limit speed of the high-pressure pump 3 is reached and therefore the pressure cannot be decreased further by influencing the pump only.

The first controller 11 is realized as standard industrial PI controller, adjusted for fast parametrization, high amplification factor and small integration time constant.

The second controller 15 is designed as industrial PID controller with the usual additional functions and operates as P controller. The same applies for the third controller 21.

The following are typical values for pressure, temperature and mass flow of the gas as well as the speed of the high-pressure pump for two load cases.

1) Load case 25%:

Pressure:

5.4 bar before high-pressure pump 203 bar after high-pressure pump 202 bar after evaporator 174 bar before diesel-gas engine Temperature:

−157° C. before high-pressure pump

−145° C. after high-pressure pump

50° C. after evaporator

Mass flow:

650 kg/h return line 22

1140 kg/h output line 7

Speed:

150 $m^{-1}$

2) Load case 85%:

Pressure:

5.4 bar before high-pressure pump 291 bar after high-pressure pump 289 bar after evaporator 278 bar before diesel-gas engine Temperature:

−157° C. before high-pressure pump

−141° C. after high-pressure pump

50° C. after evaporator

Mass flow:

3580 kg/h output line 7

Speed:

300 $m^{-1}$

3. Control Performance

In an apparatus according to the exemplary embodiment, the maximum deviations of the pressure and the mass flow of the gas from the requested setpoints were less than 1% stationary and less than 5% dynamic.

The examination of the dynamic control performance was based on two cases, namely an increase in power on the part of the consumer from 0 to 100% within two minutes and a decrease in power on the part of the consumer—as simulation of an emergency shut-off—from 100% to 0% within ten seconds.

The invention claimed is:

1. An apparatus for supplying gas comprising: a storage tank, which contains the gas as cryogenic liquefied gas, in evaporated form with controlled pressure to at least one consumer whose requirements concerning the pressure and a mass flow of the gas vary strongly;

a high-pressure pump for the liquefied gas connected to the storage tank, which delivers liquefied gas from the storage tank and increases the pressure of the liquefied gas;

a motor for adjusting the mass flow of the liquefied gas delivered by fine high-pressure pump;

an evaporator following the high-pressure pump for the liquefied gas increased in pressure;

a pressure control valve following the evaporator for the evaporated gas, to whose output the consumer can be connected;

a first controller whose control variable is the pressure of the evaporated gas behind the pressure control valve and whose correcting variable acts on the pressure control valve;

a second controller whose control variable is the pressure of the gas between the high-pressure pump and the pressure control valve and whose correcting variable acts on the motor for the mass flow.

2. The apparatus according to claim 1, further comprising: an adder for the correcting variable of the first controller and the correcting variable of the second controller, which is provided upstream of the motor for the mass flow.

3. The apparatus according to claim 2, further comprising: a signal limiter for the two correcting variables, which holds their sum in the admissible signal range of the motor for the mass flow.

4. The apparatus according to claim 1, further comprising: a transfer element whose transfer function modifies the correcting variable of the first controller as far as the first controller acts on the motor for the mass flow.

5. The apparatus according to claim 1, wherein the setpoint (SP2) of the second controller is higher than the setpoint (SP1) of the first controller.

6. The apparatus according to claim 1, with a motor for driving the high-pressure pump, whose speed, determines the mass flow of the liquefied gas delivered by the high-pressure pump, and with a speed controller for the motor.

7. The apparatus according to claim 1, further comprising: a second pressure control valve following the high-pressure pump, to whose output a return line for the liquefied gas leading to the storage tank is connected, and with a third controller whose control variable is the pressure of the liquefied gas before the second pressure control valve and whose correcting variable acts on the second pressure control valve.

8. The apparatus according to claim 7, wherein the setpoint (SP3) of the third controller is higher than the setpoint (SP2) of the second controller.

9. The apparatus according to claim 7, wherein the second controller and the third controller are connected to a common pressure sensor for the control variable.

10. Use of the apparatus according to claim 1, for supplying gas as second or alternative fuel to a marine diesel engine or a group of marine diesel engines.

* * * * *